United States Patent [19]

Seitz et al.

[11] Patent Number: 4,595,328

[45] Date of Patent: Jun. 17, 1986

[54] APPARATUS FOR TRANSFERRING SUPPORT MEMBERS FOR MATERIAL

[75] Inventors: Helmut Seitz, Reutlingen; Herbert Henne, Eningen, both of Fed. Rep. of Germany

[73] Assignee: Bullmerwerk G.O. Stumpf GmbH Spezialmaschinenfabrik, Kr. Reutlingen, Fed. Rep. of Germany

[21] Appl. No.: 492,212

[22] Filed: May 6, 1983

[30] Foreign Application Priority Data

May 17, 1982 [DE] Fed. Rep. of Germany ..... 3218544

[51] Int. Cl.[4] ..... B65H 19/12

[52] U.S. Cl. ..... 414/225; 198/339.1; 198/465.3; 242/58.6; 414/684; 414/736; 414/911; 414/917

[58] Field of Search ..... 414/745, 748, 911, 736, 414/222, 225, 751, 917, 684; 198/473, 486, 339, 681; 242/58, 58.6; 83/649; 294/67 AB, 83 R

[56] References Cited

U.S. PATENT DOCUMENTS

| | | | |
|---|---|---|---|
| 821,567 | 5/1906 | Wines | 414/911 X |
| 4,077,661 | 3/1978 | Inahashi | 294/83 R |
| 4,088,049 | 5/1978 | Benedict | 83/649 |
| 4,364,706 | 12/1982 | Kranzlmuller | 414/911 X |
| 4,383,795 | 5/1983 | Wakamatsu et al. | 414/753 |
| 4,388,039 | 6/1983 | Schwarze | 414/748 |

*Primary Examiner*—Donald W. Underwood

*Attorney, Agent, or Firm*—Scully, Scott, Murphy & Presser

[57] ABSTRACT

Bolts (10, 13) of material such as fabric, supported in open-topped bearing elements (6, 14) are exchanged by apparatus comprising a carrier (24). The carrier (24) has closable openings for engagement with spindle ends (8) projecting from the bolts (10, 13). When the carrier (24) has engaged the bolts (10, 13), it is raised (arrow 28), rotated about 180° (arrow 26) and lowered (arrow 28), so changing over the positions of the bolts (10, 13). For example, operations performed on a table (1) on material taken from one bolt (10) may be completed, so that bolt (10) is replaced by a further bolt (13) taken from a magazine (12), the first bolt (10) simultaneously taking the place of the second bolt (13) in the magazine.

16 Claims, 9 Drawing Figures

FIG. 5a
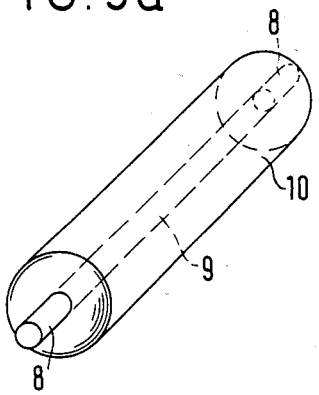
FIG. 5b
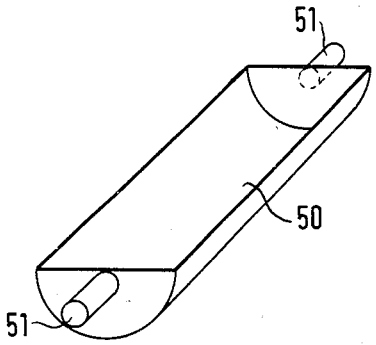
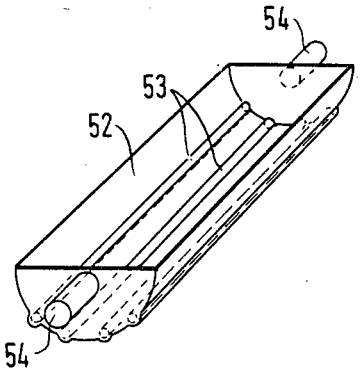
FIG. 5c
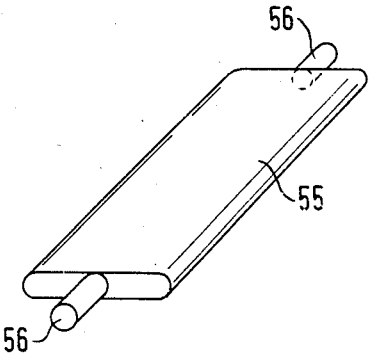
FIG. 5d

APPARATUS FOR TRANSFERRING SUPPORT MEMBERS FOR MATERIAL

BACKGROUND AND PRIOR ART

This invention relates to apparatus for transferring a support member for material, such as a spindle on which a bolt of fabric is wound, between a storage station and a processing station.

Apparatus for this purpose is known from German Gebrauchsmuster No. 78 17 607. A circulating chain, which runs over guide sprocket wheels, can be directed along guide struts. At least one holding portion, which has a hook-shaped receiving opening, is secured on the circulating chain. A locking member on the holding portion can close or leave open the receiving opening. The locking member is retracted when there is a generally vertical movement of the rotating chain and is subsequently brought back into the closed position. When there is such vertical movement in which the locking member is retracted and the receiving opening of the holding portion is left open, an end of the supporting spindle of a bolt of material or the like can be grasped from below and lifted upwards out of its bearing. The receiving opening is subsequently closed again by means of the locking member. A bolt of material or the like can be lifted out in this manner from, for example, a laying carriage of a fabric laying-out machine and also out of a bolt magazine. Lifting in follows through a reverse movement of the circulating chain. In practice, however, the apparatus is coordinated to the laying out machine and a fresh bolt of material which is to be inserted is inserted into the apparatus by hand, or a bolt of material which is to be removed from the laying-out machine, is taken out of the apparatus by hand and is inserted into the magazine.

Furthermore, apparatus is also known which operates like a crane but in an essentially similar manner to that discussed above.

Operation of the known apparatus can cause accidents and is very time-consuming. This, particularly when bolts of material are to be exchanged frequently, is a great disadvantage and gives rise to high costs as further processing is interrupted.

SUMMARY OF THE INVENTION

According to the present invention there is provided apparatus for transferring a support member for material between a storage station for the material and a processing station for the material, the support member comprising oppositely projecting support elements for engagement with open-topped bearing elements provided at the storage and processing stations, the apparatus comprising a rotary carrier having carrier arms which project generally radially from the rotary axis of the carrier in the same direction as each other, each carrier arm having a receiving portion at a location on the carrier arm away from the rotary axis of the carrier, the receiving portions being provided with respective receiving openings which open in the same direction as each other whereby angular movement of the carrier about its rotary axis causes the receiving openings to engage with respective support elements of a support member in the bearing elements at one of the stations, whereafter raising of the carrier causes the engaged support member to be lifted from the bearing elements, whereafter further angular movement of the carrier about its axis transfers the engaged support member to a position above the bearing elements at the other station, and whereafter lowering of the carrier causes the support elements of the engaged support member to enter the bearing elements at that other station.

It is particularly advantageous for there to be diametrically opposed carrier arms, because this makes it possible for there to be automatic and simultaneous exchange of support members, for example of bolts of material between a laying-out machine, affording the processing station, and a material bolt magazine, affording the storage station.

In apparatus in accordance with the present invention, bolts of material are not only lifted out of the corresponding bearing elements of processing and storage stations, by means of the same apparatus, but are also moved to the other station and deposited there by the same apparatus. Operators no longer have to intervene manually. This also makes it possible to specify from external control means, in which sequence, for example, bolts of material from a bolt magazine having numerous different bolts, are to be transferred one after the other to a laying carriage of the laying out table. This can be effected by means of a simple preselection control system.

BRIEF DESCRIPTION OF THE DRAWINGS

FIGS. 5*a* to 5*d* show other embodiments of fabric carriers for use with the handling apparatus of FIGS. 1 to 4.

DETAILED DESCRIPTION OF PREFERRED EMBODIMENTS

Figure 1:
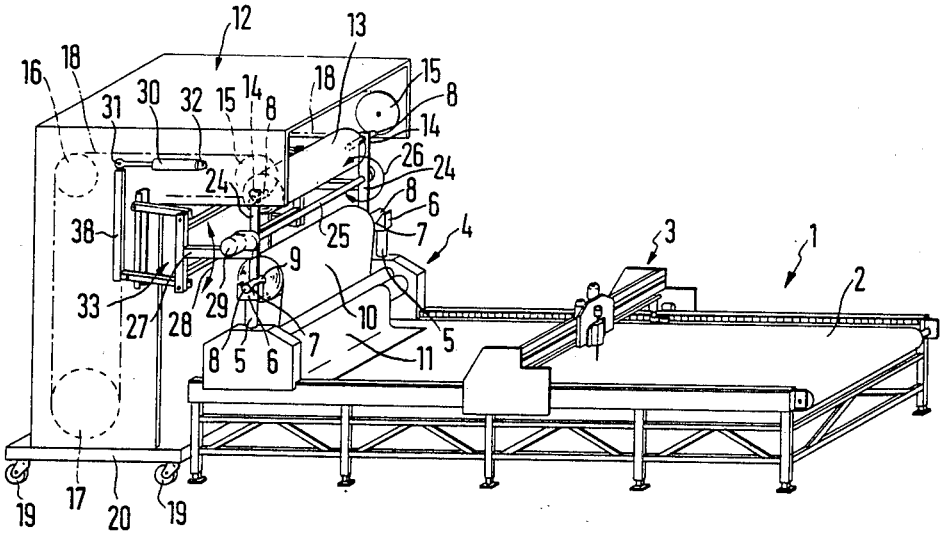
FIG. 1 is a diagrammatic perspective view of fabric handling and processing apparatus.

FIG. 1 shows a processing station comprising a laying-out and cutting out table 1 having a supporting surface 2 which, as shown is constructed as a circulating belt. A cutting-out device 3 and a laying carriage 4 are provided for travel along the table 1. From the laying carrier 4 there projects vertically upwards a pair of supports 5 which carry at their upper ends bearings 6, provided with U- or V-shaped troughs 7 so constituting open-topped bearing elements. These troughs 7 of the bearings 6 receive support elements constituted by the ends 8 of a support member in the form of a spindle 9 extending through a bolt of material 10. In operation, the laying carriage 4 draws a web of material 11 from the bolt 10 and deposits it onto the table 1. A supply of several further bolts of material, such as the bolt 13, is stored in a bolt magazine 12, constituting a storage station. A further spindle 9 having ends 8 extends through the bolt 13. The ends 8 of the spindle 9 of the bolt 13 stored in the bolt magazine 12 are received in bearings 14 which, like the bearings 6, have trough-shaped recesses. The bearings 14 are secured in a suspended manner in the illustrated embodiment of the bolt magazine 12 on a chain 18, which rotates over sprockets 15 to 17, in such a way that the bottom of the trough constantly points vertically downwards. In the embodiment shown in FIG. 1, the bolt magazine 12 is arranged on a base 20 which has rollers 19 so that the magazine 12 can be moved from one place to another if required. However, the bolt magazine 12 can alternatively be fixed. The bolt magazine 12 has drive means, such as a motor (not shown) for driving the chain 18 to bring any one of the pairs of bearings 14 into an engagement position at which a bolt of material 13 can be lifted out of, or placed in, the bearings 14. This engagement position has a specific relationship with respect to the laying carriage 4 of the table 1 as will be explained later in this description.

It is often desirable or necessary to remove the bolt 10 from the laying carriage 4 and to replace it with a bolt of material 13 from the bolt magazine 12. This need arises, for example, when a web of another material is to be laid out on the table 1 or when the material on the bolt 30 is largely used up.

The apparatus for effecting this change will now be described.

The apparatus represented in the Figures serves the purpose of simultaneously inserting and removing the bolts 10 and 13 and represents a preferred and particularly advantageous embodiment. The apparatus includes a carrier made up of a shaft 25 and two carrier arms 24 which extend equally to opposite sides of the shaft 25. Each end of each carrier arm 24 comprises a receiving portion 21. The receiving portions 21 are disposed in pairs, with each being provided with a receiving opening 22 for receiving the spindle ends 8. The opening 22 can be closed or left open by an adjustable locking member 23. Each receiving portion 21 can execute a first movement indicated by an arrow 26. For this purpose, each receiving portion 21 is mounted on or integral with one end of its carrier arm 24. The carrier arms 24 are fixed on the rotatable shaft 25 in such a way that each receiving portion 21 can be rotated about the shaft axis to perform the first movement 26. The shaft 25 is mounted on a supporting arm 27 and can be moved up and down generally vertically to perform a second movement 28. To turn the shaft 25, there is a drive means in the form of an electric motor 29 mounted, for example, on the supporting arm 27. A hydraulic cylinder 30, one end 32 of which is pivotally connected to a stationary part of the bolt magazine 12 and the other end 31 of which acts on the shaft 25 or on the supporting arm 27, is provided to effect the second movement 28.

In the embodiment of FIG. 1, the supporting arm 27 is connected with a member 34 of a parallelogram linkage 33, the member 35 which is parallel to the member 34 is fixed to a stationary part of the bolt magazine 12. The other members 36, 37 of the parallelogram linkage 33 are connected pivotably to the members 34, 35. At the end away from the supporting arm 27 of one of the latter members (the member 37 in FIG. 1) there is articulated the other end 31 of the hydraulic cylinder 30.

It is not essential for the member 35 of the parallelogram linkage 33 and the end 32 of the hydraulic cylinder 30 to be actually fixed to the bolt magazine 12. It is only essential that they maintain stationary positions; they could, for example, be provided on the laying carriage 4, on the table 1 or even on their own supporting structure which could be moved around separately from the bolt magazine 12.

In the embodiment of FIG. 1, the hydraulic cylinder 30 is generally horizontal. Its second end 31 is connected by a vertical lever 38 with the end of the member 37 away from the supporting arm 27. However, the hydraulic cylinder 30 could of course also operate vertically, in which case its end 31 could be directly connected to the member 37. Furthermore, since the essential function of the hydraulic cylinder 30 is to move the shaft 25 up and down, the hydraulic cylinder 30, or its end 31, could be applied at another location.

Figure 4:
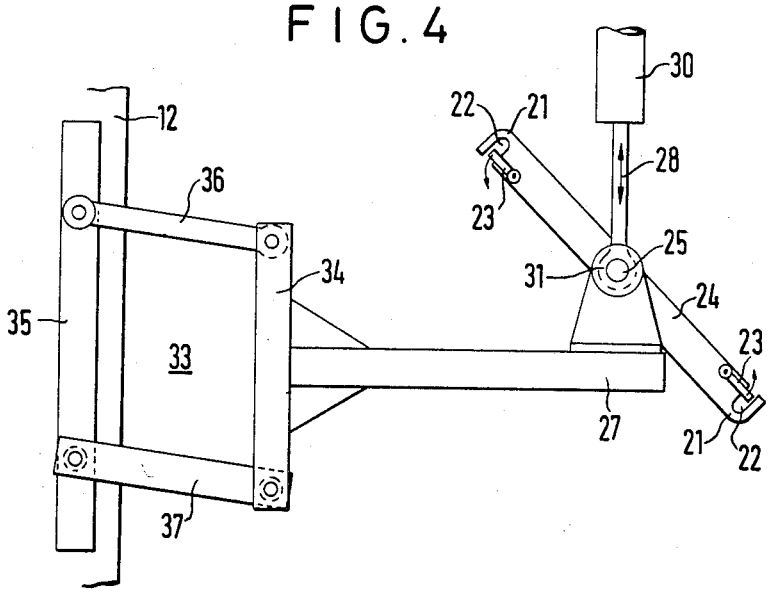
FIG. 4 is a diagrammatic side view of another embodiment of part of the apparatus.

In the alternative embodiment of FIG. 4, the end 31 of the hydraulic cylinder 30 is directly connected to the shaft 25. It could of course alternatively be connected to another location on the supporting arm 27 or on the parallelogram linkage 33. Another variant would be for the supporting arm 27 to be directly articulated to the bolt magazine 12 or to another fixed structural element, as has been mentioned.

Figure 3:
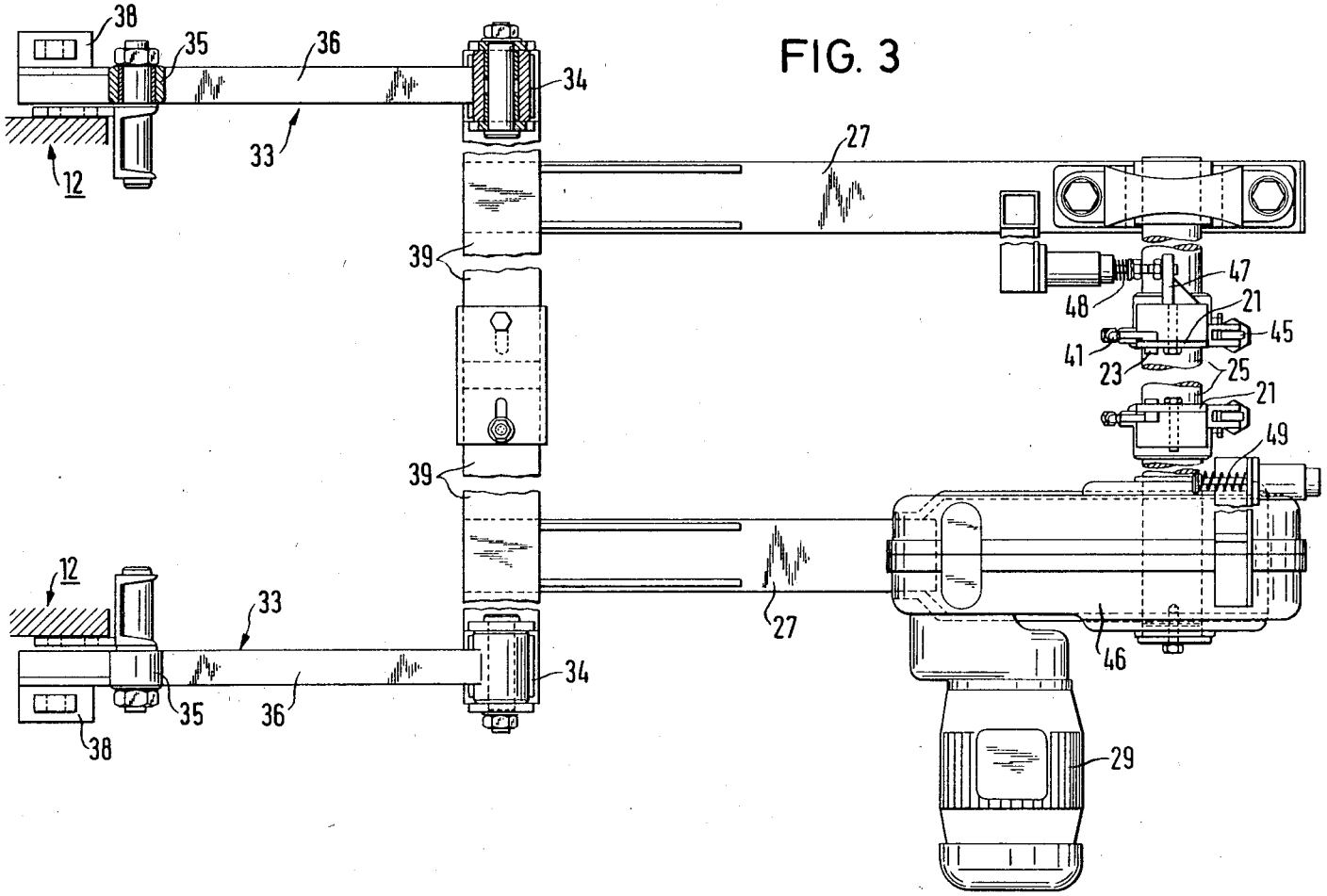
FIG. 3 is a diagrammatic plan view of part of the apparatus of FIG. 1.
Figure 6:
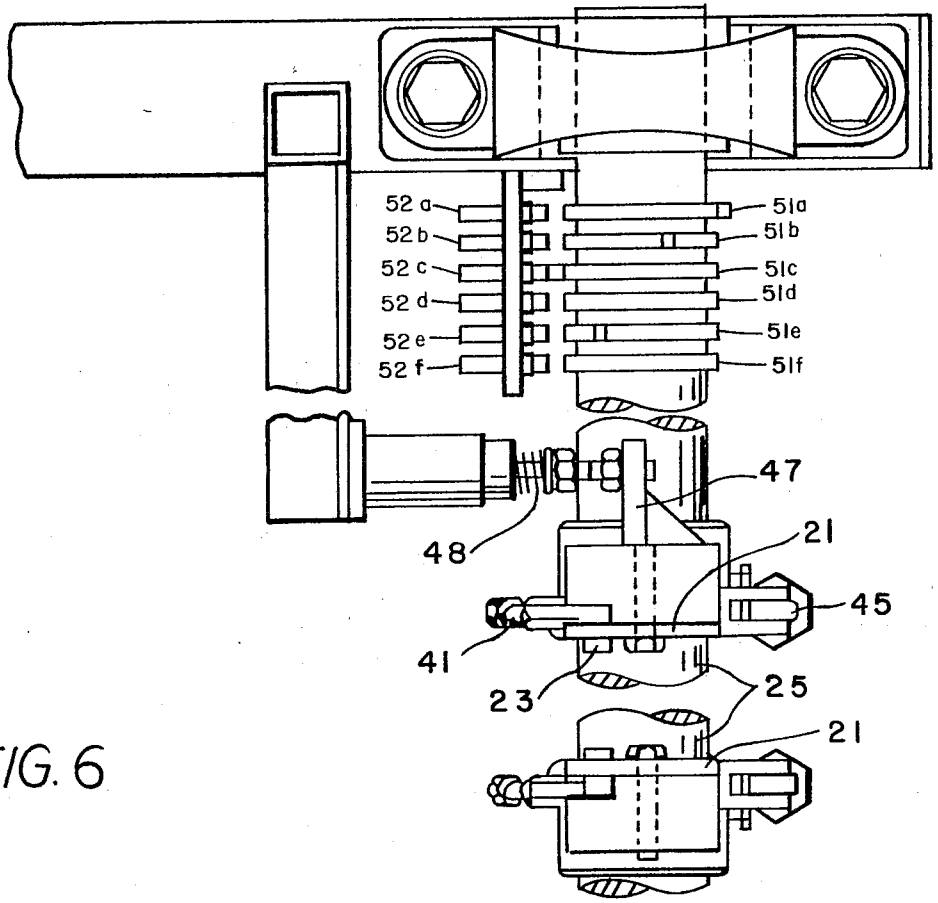
FIG. 6 is an enlarged view of a portion of FIG. 3, illustrating a plurality of control cams and switches for the apparatus shown in FIG. 1.

As a result of the considerable weight which the bolts 10, 13 or other material carriers may have, the parts of the apparatus which have just been described are advantageously constructed in a rigid manner, for example by making them from square section hollow beams, the supporting arms 27, which are provided in pairs, or the parallelogram linkages 33 being advantageously connected with each other by cross-beams 39. As shown in FIG. 3 the cross-beam 39 is constructed as two separate parts, the adjacent ends of which are interconnected by a sleeve which is welded to one of the parts and can be secured to the other part by means of a slot and a screw connection. In this way manufacturing tolerances can be taken up.

Figure 2:
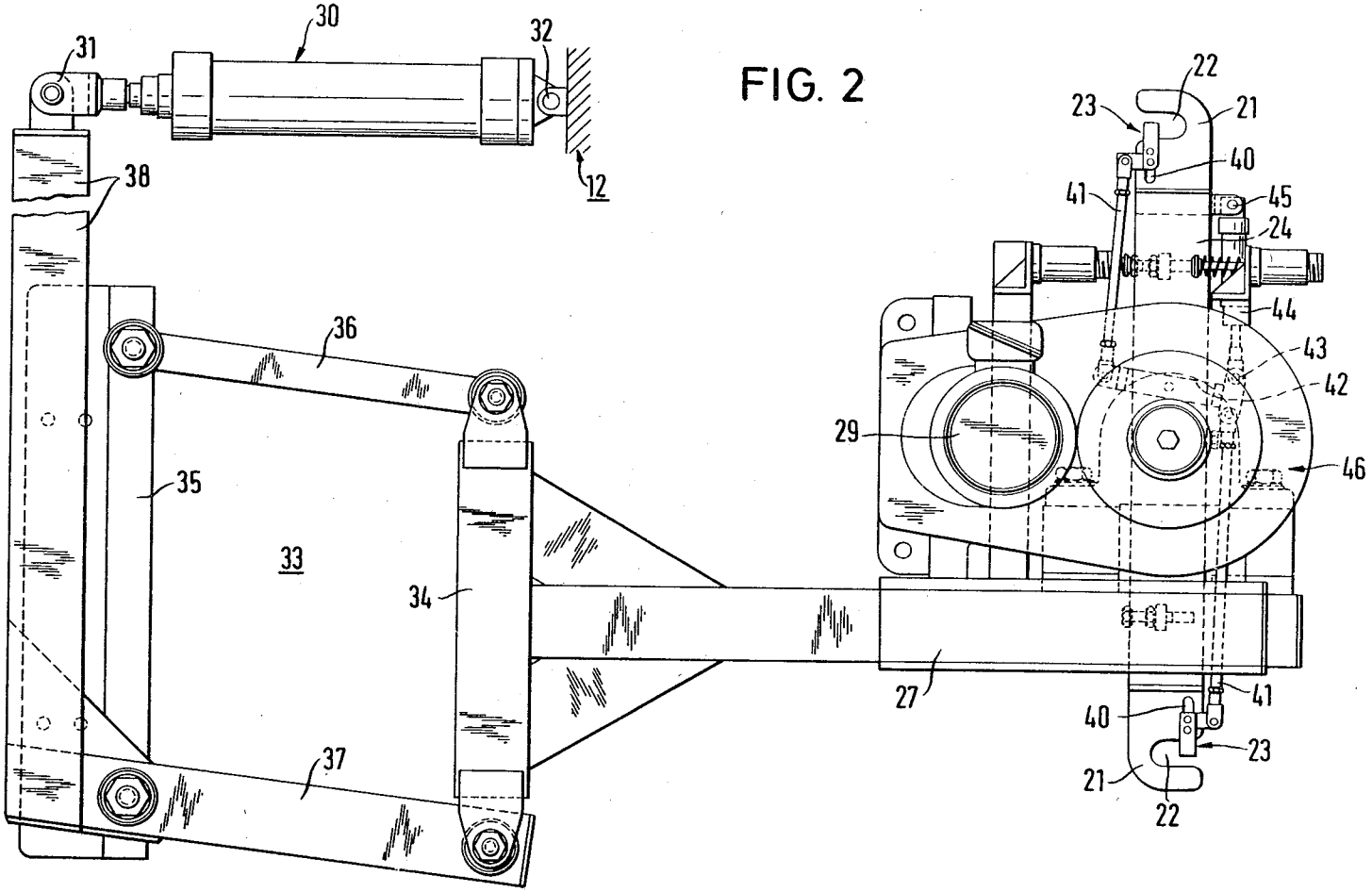
FIG. 2 is a diagrammatic side view of part of the apparatus of FIG. 1.

As explained and as shown in FIG. 4, the essential function of the locking members 23 is to close or leave open the receiving openings 22 of the receiving portions 21. To this end the locking members can, as indicated in FIG. 4, be able to swing on their receiving portions 21 or on the carrier arms 24. In the embodiment of FIGS. 2 and 3, each locking member 23 can be displaced in a guide in the form of a slot 40 which extends radially with respect to the axis of the shaft 25. One end of an operating rod 41 is pivotally connected to the end of the locking member 23 which is away from the receiving opening 22. The other end of the rod 41 is articulated to a lever 42.

The lever 42 is mounted pivotably at a position approximately centrally of the carrier. One end 43 of a hydraulic cylinder 44 acts on one end of the lever 42, the other end 45 of the hydraulic cylinder 44 being fixed to the carrier. Actuation of the hydraulic cylinder 44 turns the lever 42 about a horizontal axis to move the locking members 23 between a first position in the slot 40, in which the receiving opening 22 is left open, and a second position, in which the receiving opening 22 is closed.

In the illustrated embodiment each carrier arm 24 has a receiving portion 21 at both ends, these receiving portions 21 or at least their receiving openings 22, being equidistant from the axis of the shaft 25 on which the carrier arm 24 is mounted. The receiving openings 22 point tangentially and in the same peripheral direction as each other, and that is why respective locking members 23 can be radially directed to their slots 40. In this arrangement the rods 41 of the locking members 23 are articulated respectively to the opposite ends of the lever 42 so that the single hydraulic cylinder 44 can operate both locking members 23 in synchronism into their first and second positions.

FIG. 3 shows that the output of the electric motor 29, which may be a stepping motor, is connected to a gear unit 46 which converts the comparatively high speed of the electric motor 29 into the first movement 26 which comprises an angular movement of the shaft 25 through 180° in the illustrated embodiment.

Before further details are explained, the operation of the illustrated apparatus will be described.

As shown in FIG. 1, the bolt 10 is received in the bearings 6 of the laying-out machine 4 and the bolt 13 is received in the bearings 14 on the chain 18. Both bolts 10, 13 are in respective positions which are suitable for inserting them into, and removing them from, their bearings 6, 14. This is achieved by bring the laying carriage 4 to a position adjacent one end of the table 1, by bringing the bolt magazine 12 to a position near that end of the table 1, and by carrying the bolt 13 to its engagement position in the bolt magazine 12, for example at the lower side of the upper sprocket 15 which is nearest to the laying machine 4. The apparatus is in its lower rest position of its second movement 28, and the carrier arms 24 may be in any intermediate position of the first movement 26.

The dimensions are such that the distance between the receiving openings 22 on the carrier arms 24 is the same as the distance between the corresponding spindle ends 8 of the two bolts 10 and 13 in their respective bearings 6 and 14.

The carrier arms 24 are then turned about the shaft axis by the electric motor 29 and the gear unit 46 into an end position, the locking members 23 being in their first (open) positions at least as the carrier 24 approaches this end position. In the end position, the receiving openings 22 move over the spindle ends 8, which lie in the respective bearings 6 or 14. By actuating the hydraulic cylinder 44 the locking members 23 are brought into their second (closed) positions. The hydraulic cylinder 30 is then actuated in such a way that the apparatus effects the second movement 28 to lift the carrier into its upper rest position. The motor 29 and the gear unit 46 then operate to turn the carrier (i.e. to effect the first movement 26) to bring it into its other end position, in which the positions of the spindle ends 8, retained in the receiving openings 22 are exchanged so that the bolts 10 and 13 lie respectively above the bearings 14 or 6. By actuating the hydraulic cylinder 30 the carrier is lowered again into the lower rest position, in which the respective spindle ends 8 lie in the bearings 14 or 6. The locking members 23 are brought into the first (open) positions again by actuating the hydraulic cylinder 44 and, by actuating the electric motor 29 and the gear unit 46, the carrier is returned to the intermediate position. The simultaneous and automatic raising and lowering operation for both bolts 10 and 13 is thus completed.

It will be appreciated that the control of the individual steps of the process is of importance. More particularly, it is essential that the locking members 23 are in their second (closed) positions when the bolts are lifted out, turned and lowered again. Consequently, the detection of the angular position of the carrier or of the shaft 25 is of importance. This detection can be achieved, for example, and advantageously, by means of cams 51*a*–51*f* which are arranged on the shaft 25 and which act on switches 52*a*–52*f* which are preferably contactless and which are provided in a fixed manner on one of the supporting arms 27. The use of such switches makes it possible for the hydraulic cylinders 44 and 30 and the electric motor 29 with the gearing 46 to be controlled in the necessary manner. In order to trigger the closing and the opening operations for the locking members 23, a stop control can also be used, in which a member 47, connected with one of the carrier arms 24, engages a release switch 48 in an end position of the first movement 26 as is diagrammatically represented in FIGS. 2 and 3. The release switch 48 can be constructed thereby at the same time as a sprung shock absorber. Shock absorbers 49 can also be provided separately to determine the end positions of the first movement 26.

In the embodiment of FIG. 1, the respective bearings 6 or 14 lie vertically one above the other in the positions in which the bolts are inserted and removed. This is not essential, provided that the bearings 6 and 14 are at a distance from each other which is the same as the distance between the receiving openings 22 of the carrier arms 24. The arrangement shown, however, has the advantage that the weight of the comparatively heavy bolts of material does not act directly upon the relatively vulnerable locking members 23 when lifting or lowering the bolts during the second movement 28.

The illustrated embodiment has the particular advantage that, by means of an easily controlled sequence of movements, two bolts of material can be simultaneously and automatically exchanged with one another. In this manner the space which is available in the bolt magazine 12 can be utilised to the maximum, since an empty place for the bolt of material 10, which is to be removed from the laying carriage 4, is not necessary.

Nevertheless, to provide a particularly simple embodiment, each of the carrier arms 24 can have a receiving portion 21 at one end only. The receiving portion 21 is first of all lowered from an elevated position to the bolt 10 in the laying carriage 4. The receiving opening 22 can be oriented at random, provided that, when lowering, it can encompass the spindle end 8. After lifting out the bolt from the bearings 6 of the laying carriage 4, the carrier is turned until the lifted bolt 10 lies above empty bearings 14 of the bolt magazine 12. The bolt 10 is then lowered and released so that it is now deposited in the bolt magazine 12.

Subsequently, in the same way, a fresh bolt 13 is lifted out of the bolt magazine 12 and, after turning, is deposited into the now empty bearings 6 of the laying carriage 4. Although this mode of operation is quicker than that of known apparatus, it is clearly slower and more unfavourable than that of the preferred embodiment explained above. The mentioned tangential direction of the receiving openings 22 in the receiving portions 21 has not only the mentioned advantage that the locking members 23 are not directly loaded when lifting out. If the receiving opening 22 is directed in another direction in the case of the carrier 24 with a receiving portion 21 provided at both ends, then the control system for lifting out both bolts of material 10, 13 from the respective bearings 6 and 14 and also the subsequent insertion process becomes more complicated since an individual control system is necessary for each of the bearings, it no longer being possible to use a single lifting cylinder 30 and a single hydraulic cylinder 44. Instead, multistage and multi-step control operations are necessary which are not explained in detail but which will be apparent to the skilled man from the respective directions of the receiving openings 22.

The distance between the supporting arms 27 must be greater than the distance between the ends 8 of the spindle 9. The distance betweem the carrier arms 24 on the shaft 25 must of course be smaller than the distance between the ends 8. The distance between the carrier arms 24 must also be greater than the width of the material on the bolts, including winding tolerance, and is advantageously smaller than the distance between the respective bearings 6 or 14.

The above description is based on bolts having support members in the form of spindles, as shown in FIG. 5*a*. However, other support members and of course other materials can be used. According to FIG. 5*a* a bolt 10 has an inserted spindle 9, having ends 8. FIG. 5*b* shows a trough 50 from which rod-like ends 51 project, these ends 51 corresponding to the ends 8 of the spindles 9. FIG. 5*c* shows a roller trough 52 which has rollers 53 which are rotatable in the region of the trough wall. From the end walls of the roller trough 52 project rod-like ends 54 which correspond to the ends 8 of the spindle 9 of FIG. 5*a*. Bolts of material can be dropped into the troughs 50 and 52. FIG. 5*d* shows a pallet 50 from which ends 56 extend laterally, corresponding to the ends 8 of the spindle 9 of FIG. 5*a*. Material can be wound onto the pallet 55. Material can also be laid in folds on one side of the pallet 55, in which case special guides must be provided in addition in order that the pallet 55 remains substantially horizontal.

Although the above description has referred to bolts of material, implying textile fabrics, the invention can also be used in connection with other materials to be conveyed and handled by means of spindles and/or troughs and/or pallets, such as paper, paperboard, plastic foils and the like. According to the respective material the magazine, which serves as supply, and the machine, which is provided as a processing arrangement, are constructed accordingly in an adapted manner.

Of course yet more embodiments are possible.

We claim:

1. Material processing equipment comprising:

a storage station;

a processing station;

open-topped bearing elements in the storage station and the processing station for receiving oppositely projecting support elements of a material support member; and apparatus for transferring the support member between the storage station and the processing station, the apparatus comprising:

a rotary carrier having a rotary axis, first and second carrier arms connected to the rotary carrier and projecting generally radically from the rotary axis in a first direction, each carrier arm having a receiving portion forming a receiving opening spaced from the rotary axis for receiving support elements of a support member;

a support arm rotatably supporting the rotary carrier;

a parallelogram linkage supporting the support arm for vertical movement to effect lifting and lowering of the rotary carrier, the support arm extending substantially horizontal from the parallelogram linkage; and drive means to move the rotary carrier about the rotary axis and to displace the support arm to effect lifting and lowering of the rotary carrier to cause the receiving openings to engage support elements of a support member in the bearing elements at one of the stations, raise the rotary carrier to lift the engaged support member from the bearing elements at said one station, further move the rotary carrier about its rotary axis to transfer the engaged support member to a position above the bearing elements at the other station, and lower the rotary carrier to lower the support elements of the support member onto the bearing elements at that other station.

2. Material processing equipment as claimed in claim 1, in which the respective bearing elements at the storage and processing stations are disposed vertically one above the other.

3. Material processing equipment as claimed in claim 1, in which the rotary axis of the carrier is midway between the respective bearing elements at the storage and processing stations.

4. Material processing equipment as claimed in claim 1, in which the storage station is afforded by a material bolt magazine, and in which the processing station is afforded by a material laying out machine.

5. Material processing equipment as claimed in claim 1 wherein the support member comprises a spindle on which material is wound.

6. Apparatus for transferring a material support member between a material storage station and a material processing station, the support member comprising oppositely projecting support elements for engagement with open-topped bearing elements provided at the storage and processing stations, the apparatus comprising:

a support frame including first and second spaced apart support arms, a first bracket secured to the first support arm in a fixed position relative thereto, and a second bracket secured to the second support arm in a fixed position relative thereto;

a carrier shaft having a rotary axis and extending between and rotatably supported by the first and second brackets;

first and second carrier arms connected to the carrier shaft and projecting generally radially from the rotary axis in a first direction;

third and fourth carrier arms connected to the carrier shaft and extending diametrically opposite the first and second carrier arms for the same distance from the rotary axis as said first and second carrier arms;

each carrier arm having a receiving portion forming a receiving opening spaced from the rotary axis for receiving a support element of a support member;

carrier drive means mounted on one of said support arms and conected to the carrier shaft to rotate the carrier arms between a first position wherein the first and second carrier arms extend upward from the rotary axis and the third and fourth carrier arms extend downward therefrom, and a second position wherein the first and second carrier arms extend downward from the rotary axis and the third and fourth carrier arms extend upward therefrom, to cause the receiving opening of the first and second carrier arms to engage support elements of a first support member in the bearing element at the material storage station and subsequently transfer the first support member to a position above the bearing elements of the material processing station, and to cause the receiving openings of the third and fourth carrier arms to engage support elements of a second support member in the bearing elements at the material processing station and subsequently transfer the second support member to a position above the bearing elements of the material storage station; and support arm drive means connected to the support frame to raise and lower the support arms and the carrier shaft to lift the support members from, and subsequently lower the support members onto, the bearing elements at the material processing and storage stations.

7. Apparatus according to claim 6 wherein:

the first carrier arm is integral with the third carrier arm, and the second arm is integral with the fourth carrier arm; and the rotary axis is disposed midway between the receiving openings of the first and third carrier arms and midway between the receiving openings of the second and fourth carrier arms.

8. Apparatus for transferring material support member between a material storage station and a material processing station, the support member comprising oppositely projecting support elements for engagement with open-topped bearing elements provided at the storage and processing stations, the apparatus comprising:

a rotary carrier having a shaft and a rotary axis;

first and second carrier arms secured to the rotary carrier and projecting generally from the rotary axis in a first direction;

each carrier arm having a receiving portion spaced from the rotary axis and forming a reciving opening spaced from the rotary axis for receiving support elements of a support member;

a substantially horizontal supporting arm supporting the ends of the shaft;

a parallelogram linkage supporting the supporting arm for verticle movement to raise and lower the supporting arm;

drive means connected to the rotary carrier to move the rotary carrier about the rotary axis and cause the receiving openings to engage the support elements of a support member in the bearing elements at one of the stations, to raise the carrier and lift the engaged support member from the bearing elements at said one station, to further move the carrier about the rotary axis and transfer the engaged support member to a position above the bearing elements at the other station, and to lower the carrier and lower the support elements of the engaged support member onto the bearing elements at that other station;

first and second locking pins supported on the first and second carrier arms for movement between a closed position to lock a support member in the receiving openings, and an open position to allow the support member to move into and out from the receiving openings.

9. Apparatus according to claim 8 wherein:

the parallelogram linkage includes first and second members connected together for pivotal movement of said second member about a first pivot point, and third and fourth members pivotally connected to the first and second members so that the third member moves parallel to the first member and the fourth member moves parallel to the second member;

the supporting arm is rigidly connected to the third member;

the drive means includes supporting arm drive means connected to the parallelogram linkage to pivot the second member about the first pivot point and thereby raise and lower the supporting arm and the rotary carrier.

10. Apparatus according to claim 8 wherein the drive means includes an electric motor mounted on the supporting arm and connected to the rotary carrier to move the rotary carrier about the rotary axis.

11. Apparatus according to claim 8 wherein the drive means includes an expansible cylinder and piston unit connected to the rotary carrier shaft to raise and lower the carrier.

12. Apparatus according to claim 8 further comprising means for controlling movement of the locking pins between the open and closed positions, the controlling means including a plurality of cams connected to the rotary carrier and rotatable therewith about the rotary axis.

13. Apparatus according to claim 12 wherein the controlling means further includes contactless switches actuated by the cams.

14. Material processing equipment according to claim 1 wherein the support member comprises a trough in which material is received.

15. Material processing equipment according to claim 1 wherein the support member comprises a roller trough in which material is received.

16. Material processing equipment according to claim 1 wherein the support member comprises a pallet on which material is supported.

* * * * *